US009873265B2

(12) United States Patent
Niitsu et al.

(10) Patent No.: US 9,873,265 B2
(45) Date of Patent: Jan. 23, 2018

(54) IRRADIATION DEVICE AND IMAGE FORMING APPARATUS

(71) Applicant: FUJI XEROX CO., LTD., Tokyo (JP)

(72) Inventors: Takehiro Niitsu, Kanagawa (JP); Jun Isozaki, Kanagawa (JP); Hiroyuki Tsukuni, Kanagawa (JP); Akira Sakamoto, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 15/346,811

(22) Filed: Nov. 9, 2016

(65) Prior Publication Data

US 2017/0361625 A1 Dec. 21, 2017

(30) Foreign Application Priority Data

Jun. 21, 2016 (JP) ..... 2016-122794

(51) Int. Cl.

| | |
|---|---|
| ***B41J 29/12*** | (2006.01) |
| ***B41J 11/00*** | (2006.01) |
| *B41M 7/00* | (2006.01) |

(52) U.S. Cl.

CPC ..... *B41J 11/002* (2013.01); *B41J 29/12* (2013.01); *B41M 7/00* (2013.01)

(58) Field of Classification Search

CPC ..... B41J 11/002; B41J 29/12; B41M 7/00
See application file for complete search history.

(56) References Cited

U.S. PATENT DOCUMENTS

2016/0167399 A1* 6/2016 Ohnishi ..... B41J 2/01 347/102

FOREIGN PATENT DOCUMENTS

| | | | |
|---|---|---|---|
| JP | 2013-57855 | 3/2013 | |
| JP | 2014-184666 | * 10/2014 | ..... B41J 2/01 |
| JP | 2015-9376 | 1/2015 | |
| JP | 2015-122485 | * 7/2015 | ..... B41J 2/01 |
| JP | 2015-147347 | 8/2015 | |

OTHER PUBLICATIONS

Abstract and machine translation of JP 2015-147347.
Office Action dated Jan. 24, 2017 in corresponding Japanese application No. 2016-122794.
English translation of Office Action dated Jan. 24, 2017 in corresponding Japanese application No. 2016-122794.
Abstract and machine translation of JP 2014-184666.
Abstract and machine translation of JP 2015-122485.
Abstract and machine translation of JP 2013-57855.
Office Action dated Apr. 4, 2017 in corresponding Japanese application No. 2016-122794.
English translation of Office Action dated Apr. 4, 2017 in corresponding Japanese application No. 2016-122794.

* cited by examiner

*Primary Examiner* — Manish S Shah
*Assistant Examiner* — Yaovi M Ameh
(74) *Attorney, Agent, or Firm* — Fildes & Outland, P.C.

(57) ABSTRACT

An irradiation device includes: an irradiation unit that irradiates a target with light; at least one component that is arranged in an advancing direction of light reflected by the target; and a light blocking unit that is arranged between the target and the at least one component in the advancing direction and blocks the reflected light.

5 Claims, 10 Drawing Sheets

IRRADIATION DEVICE AND IMAGE FORMING APPARATUS

CROSS-REFERENCE TO RELATED APPLICATIONS

This application is based on and claims priority under 35 USC 119 from Japanese Patent Application No. 2016-122794 filed on Jun. 21, 2016.

BACKGROUND

Technical Field

The present invention relates to an irradiation device and an image forming apparatus.

SUMMARY

According to an aspect of the invention, there is provided an irradiation device comprising: an irradiation unit that irradiates a target with light; at least one component that is arranged in an advancing direction of light reflected by the target; and a light blocking unit that is arranged between the target and the at least one component in the advancing direction and blocks the reflected light.

BRIEF DESCRIPTION OF THE DRAWINGS

Exemplary embodiments of the present invention will be described in detail based on the following figures, wherein.

DESCRIPTION OF REFERENCE NUMERALS AND SIGNS

10: image forming apparatus

40: ejection head (an example of the image forming unit)

50, 150, 250, 350, 450, 550: drying device (an example of the irradiation device)

54: glass plate (an example of the transmitting member)

58: chip (an example of the irradiation unit)

60: printed wiring board (an example of the component)

62: flexible printed circuit (an example of the component)

64: thermistor (an example of the component)

76: light blocking unit

186: reflecting film (an example of the reflecting unit; an example of the light blocking unit)

288: absorbing film (an example of the absorbing unit)

L1: laser beam (an example of the light)

L2: reflected light

P: continuous-form paper (an example of the target an example of the recording medium)

DETAILED DESCRIPTION

Hereinafter, description will be given of an exemplary embodiment of the invention based on drawings.

(Image Forming Apparatus 10)

Figure 1:
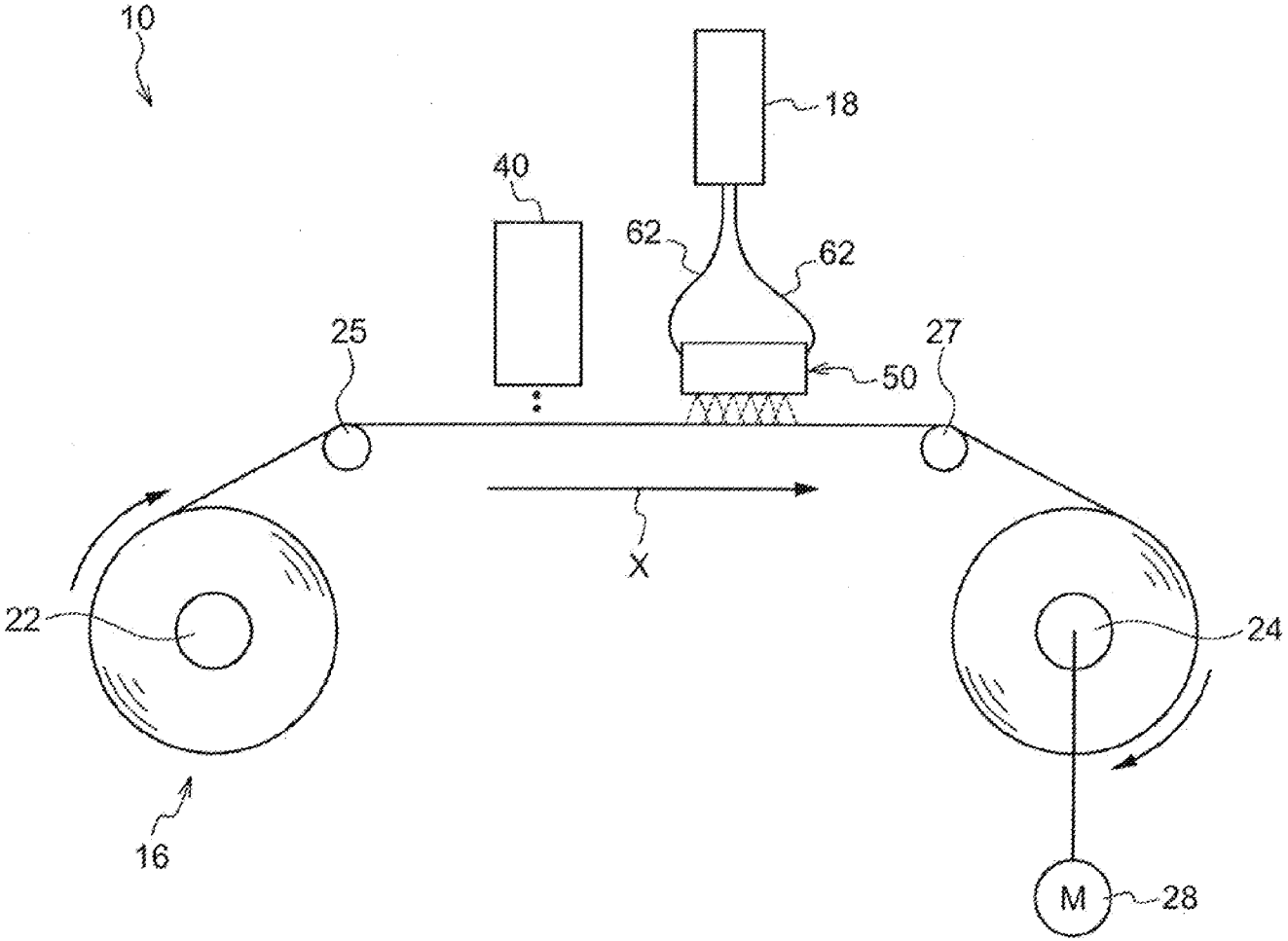
FIG. 1 is an outline diagram illustrating a configuration of an image forming apparatus according to an exemplary embodiment.

First, description will be given of an image forming apparatus 10 (ejection apparatus). FIG. 1 is an outline diagram illustrating a configuration of the image forming apparatus 10.

The image forming apparatus 10 is an apparatus that feeds a continuous-form paper P (an example of the recording medium, an example of the target) in a predetermined feeding direction X, ejects liquid droplets onto the continuous-form paper P, and forms an image. Specifically, the image forming apparatus 10 is provided with a feeding unit 16, an ejection head 40 (an example of the image forming unit), a drying device 50 (an example of the irradiation device), and a drive circuit 18 as illustrated in FIG. 1.

The election head 40 and the drying device 50 are arranged in this order from an upstream side toward a downstream side of the feeding direction X of the continuous-form paper P. Therefore, an ejecting operation and a drying operation are executed in this order on each part of the continuous-form paper P fed by the feeding unit 16.

(Feeding Unit 16)

The feeding unit 16 is a part with a function of feeding the continuous-form paper P. Specifically, the feeding unit 16 includes a unwinding roll 22 from which the continuous-form paper P is unwound, a winding roll 24 which winds the continuous-form paper P, and stretching rolls 25 and 27. The winding roll 24 is driven ad rotated in a winding direction (the clockwise direction in FIG. 1) by the drive unit 28. In doing so, the continuous-form paper P is pulled toward the side of the winding roll 24, and the unwinding roll 22 unwinds the continuous-form paper P. In this way, the continuous-form paper P is fed in the feeding direction X from the unwinding roll 22 to the winding roll 24 in a state where tension force is applied to the continuous-form paper P by the drive unit 28 driving and rotating the winding roll 24.

The continuous-form paper P is stretched over the stretching roll 25 between the unwinding roll 22 and the ejection head 40. The continuous-form paper P is stretched over the stretching roll 27 between the drying device 50 and the winding roll 24. This defines a feeding path of the continuous-form paper P from the unwinding roll 22 to the winding roll 24.

(Ejection Head 40)

The ejection head 40 (an example of the image forming unit) functions as an ejection unit that ejects ink droplets (an example of the liquid droplets) onto the continuous-form paper P. Specifically, the ejection head 40 ejects black ink droplets onto the continuous-form paper P and forms an image on the continuous-form paper P.

(Drying Device 50)

Figure 2:
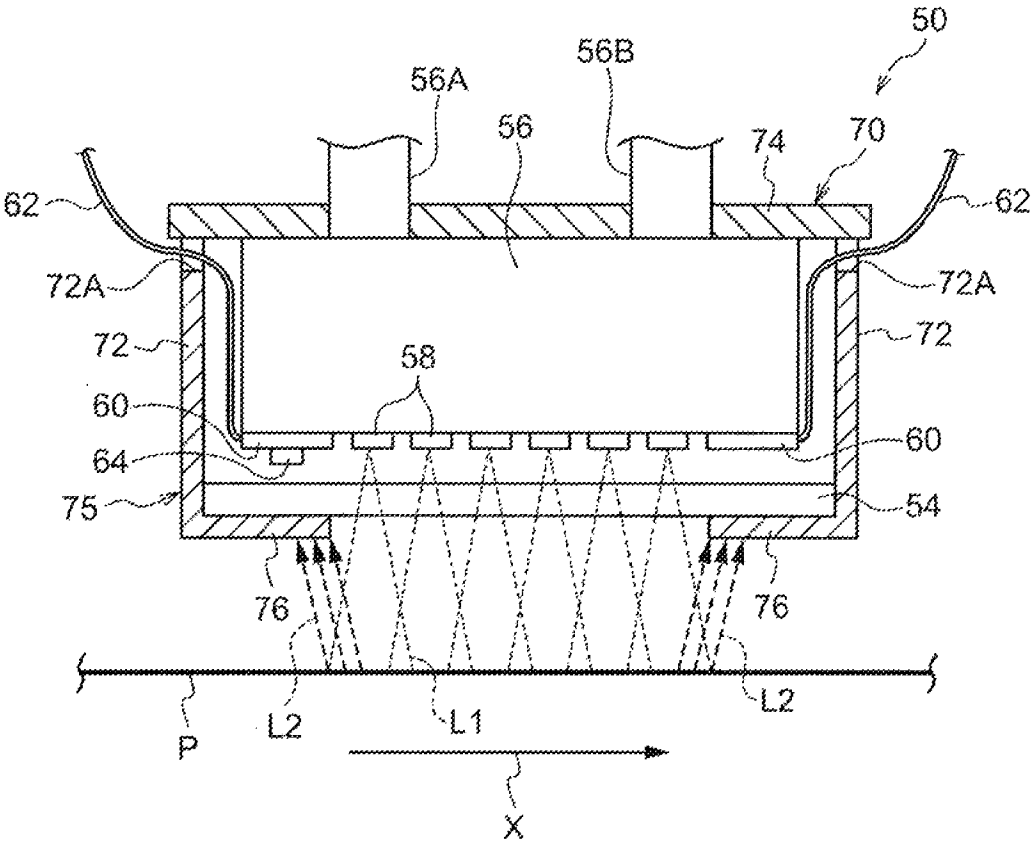
FIG. 2 is a front sectional view illustrating a configuration of a drying device according to the exemplary embodiment.

The drying device 50 (an example of the irradiation device) is a device that dries the continuous-form paper P onto which the ink droplets have been ejected. Specifically, the drying device 50 includes a case body 70, a glass plate 54, coolers 56, and vertical cavity surface emitting laser (VCSEL) chips 58 (an example of the irradiation unit) as illustrated in FIG. 2. Furthermore, the drying device 50 includes printed wiring boards 60 (an example of the component), flexible printed circuits 62 (an example of the component), and thermistors 64 (an example of the component).

Figure 3:
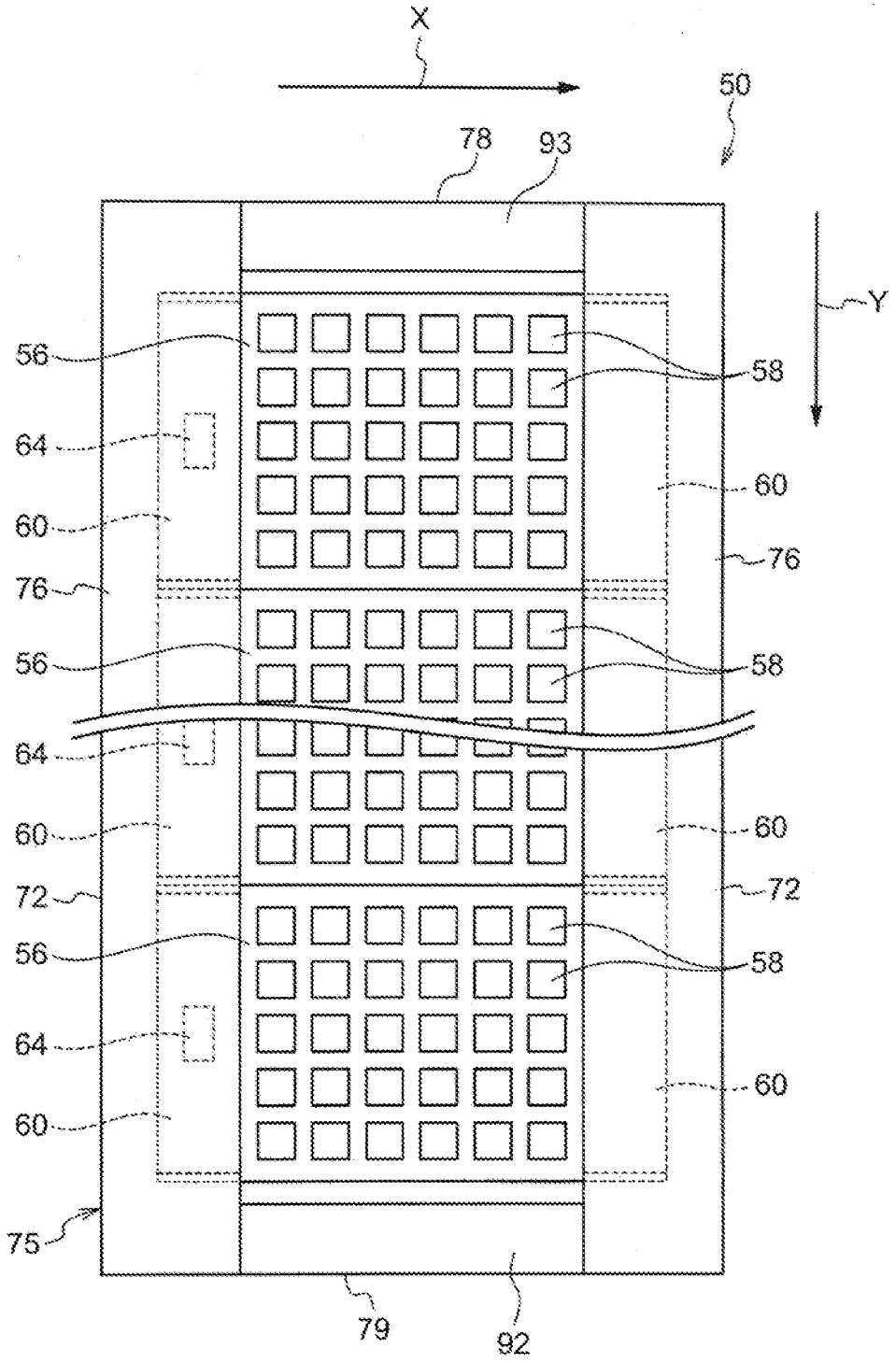
FIG. 3 is a bottom view illustrating the configuration of the drying device according to the exemplary embodiment.

The plural coolers 56 are arranged in an intersecting direction Y (a width direction of the continuous-form paper P) that intersects the feeding direction X of the continuous-form paper P as illustrated in the bottom view of FIG. 3. The glass plate 54 is omitted in FIG. 3.

The plural chips 58 are mounted on the lower surfaces of the respective coolers 56 as illustrated in FIG. 2. Specifically, the chips 58 are arranged in a two-dimensional manner (6×5 in the example of FIG. 4) on the lower surfaces of the respective coolers 56 as illustrated in FIG. 3. The respective chips 58 irradiates the continuous-form paper P with a laser beam L1 (an example of the light) as illustrated in FIG. 2. Moisture in ink is evaporated by the respective chips 58 irradiating the continuous-form paper P with the laser beam L1, thereby drying a portion where an image has been formed on the continuous-form paper P. The chips 58 have intervals of about 10 mm, for example, from the continuous-form paper P.

Each of the coolers 56 is formed into a rectangular parallelepiped shape inside which a flow path (not shown) for distributing cooling water is formed. In each cooler 56, the cooling water that has flow to the inside through a flow-in tube 56A is distributed through the flow path formed inside and then flows out to a flow-out tube 56B. In this way, each chip 58 mounted on the lower surface of each cooler 56 is cooled. The upper surface of each cooler 56 is attached to an upper wall 74, which will be described later, of the case body 70.

Figure 4:
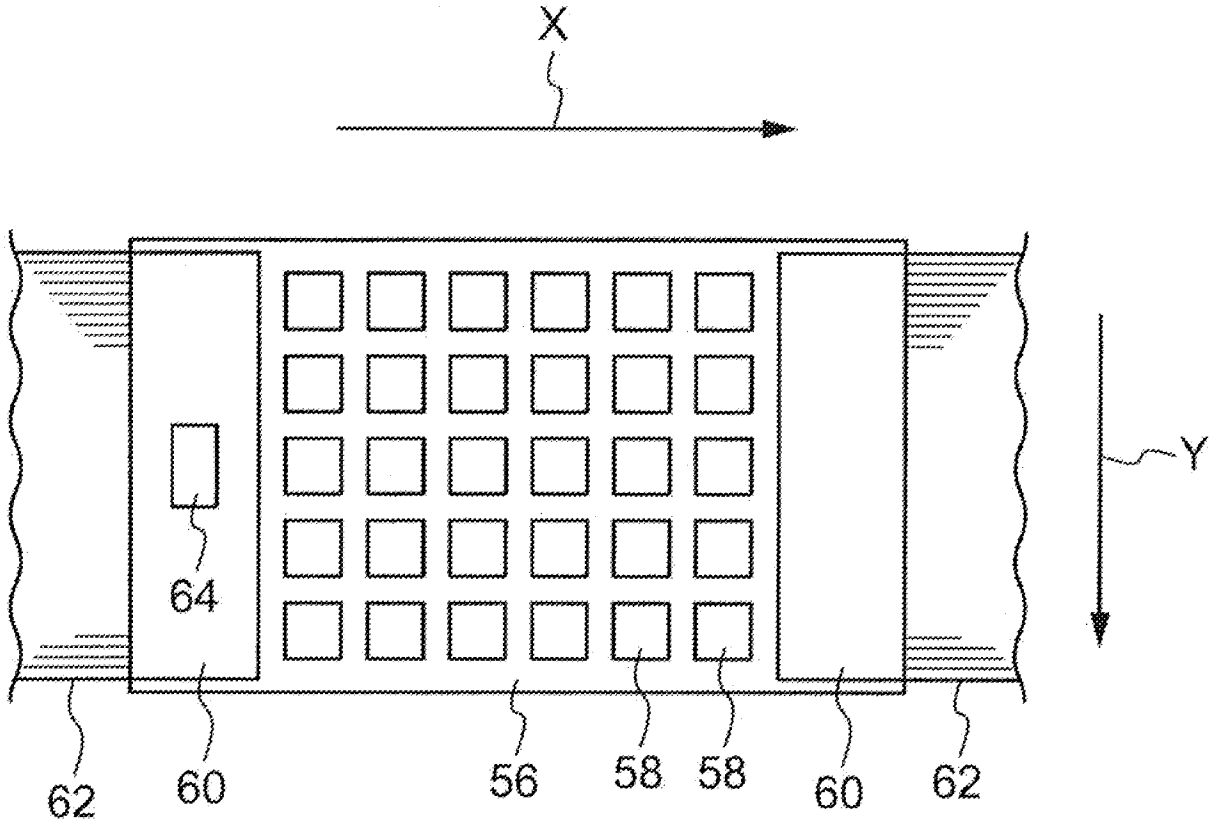
FIG. 4 is a bottom view illustrating a configuration of a cooler according to the exemplary embodiment.

The printed wiring boards 60 are respectively arranged on one side (an upstream side in the feeding direction X of the continuous-form paper P) and the other side (a downstream side in the feeding direction X of the continuous-form paper P) of the chips 58 arranged in the two-dimensional shape as illustrated in the bottom view of FIG. 4. The printed wiring boards 60 are electrically connected to the respective chips 58.

The flexible printed circuits 62 are boards that function as wiring and are electrically connected to the two respective printed wiring boards 60. Specifically, each of the flexible printed circuits 62 has one end connected to each printed wiring board 60 and the other end connected to the drive circuit 18 (see FIG. 1). The flexible printed circuits 62 are drawn to the outside of the case body 70 through openings 72A in side walls 72, which will be described later, of the case body 70 as illustrated in FIG 2.

A drive signal and electric power are supplied from the drive circuit 18 to the respective chips 58 via the flexible printed circuits 62 and the printed wiring boards 60, and the respective chips 58 are driven.

The thermistors 64 are arranged on the flexible printed circuits 62 that are arranged on one side (the upstream side in the feeding direction X of the continuous-form paper P) of the chips 58 as illustrated in FIGS. 2 and 4. The thermistors 64 function as detection units that detect the temperature of the printed wiring boards 60.

The case body 70 is formed of a metal material, for example, and has heat dissipation. Specifically, the case body 70 includes the pair of side walls 72, the upper wall 74, light blocking units 76, a front wall 78 (see FIG. 3), and a back wall 79 (see FIG. 3) as illustrated in FIG. 2.

The front wall 78 and the back wall 79 are arranged on the front side (the closer side of the plane of the paper of FIG. 2) and the back side (the further side of the plane of the paper of FIG. 2) in a front view (see FIG. 2). That is, the front wall 78 and the back wall 79 are arranged on one side and the other side in the intersecting direction Y with respect to the plural coolers 56 as illustrated in FIG. 3.

The pair of side walls 72 are arranged on the upstream side and the downstream side in the feeding direction X with respect to the plural coolers 56 as illustrated in FIG. 2. The openings 72A through which the respective flexible printed circuits 62 are made to pass are formed at the upper portion in the side walls 72.

The pair of side walls 72 are coupled to the front wall 78 and the back wall 79 and surround our sides of the coolers 56 in a plan view (bottom view) along with the front wall 78 and the back wall 79. That is, the pair of side walls 72, the front wall 78, and the back wall 79 form a peripheral wall 75 that surrounds the coolers 56.

The upper wall 74 is coupled to upper end of the peripheral wall 75 (the pair of side walls 72, the front wall 78, and the back wall 79) and closes the upper side of the peripheral wall 75. The coolers 56 are attached to the bottom surface of the upper wall 74. Also, the flow-in tube 56A and the flow-out tube 56B connected to the coolers 56 penetrate through the upper wall 74.

The glass plate 54 is arranged between the chips 58 provided at the plural coolers 56 and the continuous-form paper P and closes the lower side of the peripheral wall 75. In doing so, a closed space is formed inside the case body 70 except for the openings 72A. The glass plate 54 has a function of protecting the chips 58 from water vapor generated by moisture in the ink being evaporated by the irradiation with the laser beam L1, ink mist, paper dust from the continuous-form paper P, and the like.

Portions of the glass plate 54 on the upstream side and the downstream side in the feeding direction X are supported from the lower side by the light blocking units 76 that block light L2 reflected by the continuous-form paper P. That is, the light blocking units 76 also function as support units that support the glass plate 54 from the side of the continuous-form paper P. The light blocking units 76 are provided integrally with the lower ends of the side walls 72.

Portions of the glass plate 54 on one side and the other side in the intersecting direction Y are supported from the lower side by support units 92 and 93 (see FIG. 3).

Here, the printed wiring boards 60, a part of the flexible printed circuits 62, and the thermistors 64 (hereinafter, collectively referred to as components 60, 62, and 64) are arranged in an advancing direction in which the light L2 reflected by the continuous-form paper P advances as illustrated in FIG. 2 in the exemplary embodiment. The reflected light L2 described herein is mainly light regularly reflected by the continuous form paper P.

In addition, the light blocking units 76 are arranged between the continuous-form paper P and the components 60, 62, and 64 in the advancing direction of the reflected light L2. The light blocking units 76 have a function of blocking the reflected light L2 advancing toward the components 60, 62, and 64.

The two light blocking units 76 have a gap therebetween and secure a light path of the laser beam L1 emitted from the chips 58 to the continuous-form paper P. The light blocking units 76 are irradiated with stray light or laser beam emitted in a wide angle region in the laser beam L1 emitted from the chips 58 in some cases.

(Effects of Exemplary Embodiment)

Next, description will be given of effects of the exemplary embodiment.

According to the image forming apparatus 10 of the exemplary embodiment, the ejection head 40 ejects ink droplets onto the continuous-form paper P fed in the feeding direction X from the unwinding roll 22 to the winding roll 24, thereby forming an image on the continuous-form paper P as illustrated in FIG. 1. The portion, in which the image has been formed, of the continuous-form paper P is fed to the drying device 50 and is then irradiated with the laser beam L1 from the chips 58 as illustrated in FIG. 2. In doing so, the moisture in the ink is evaporated, and the portion, in which the image has been formed, of the continuous-form paper P is dried.

Figure 5:
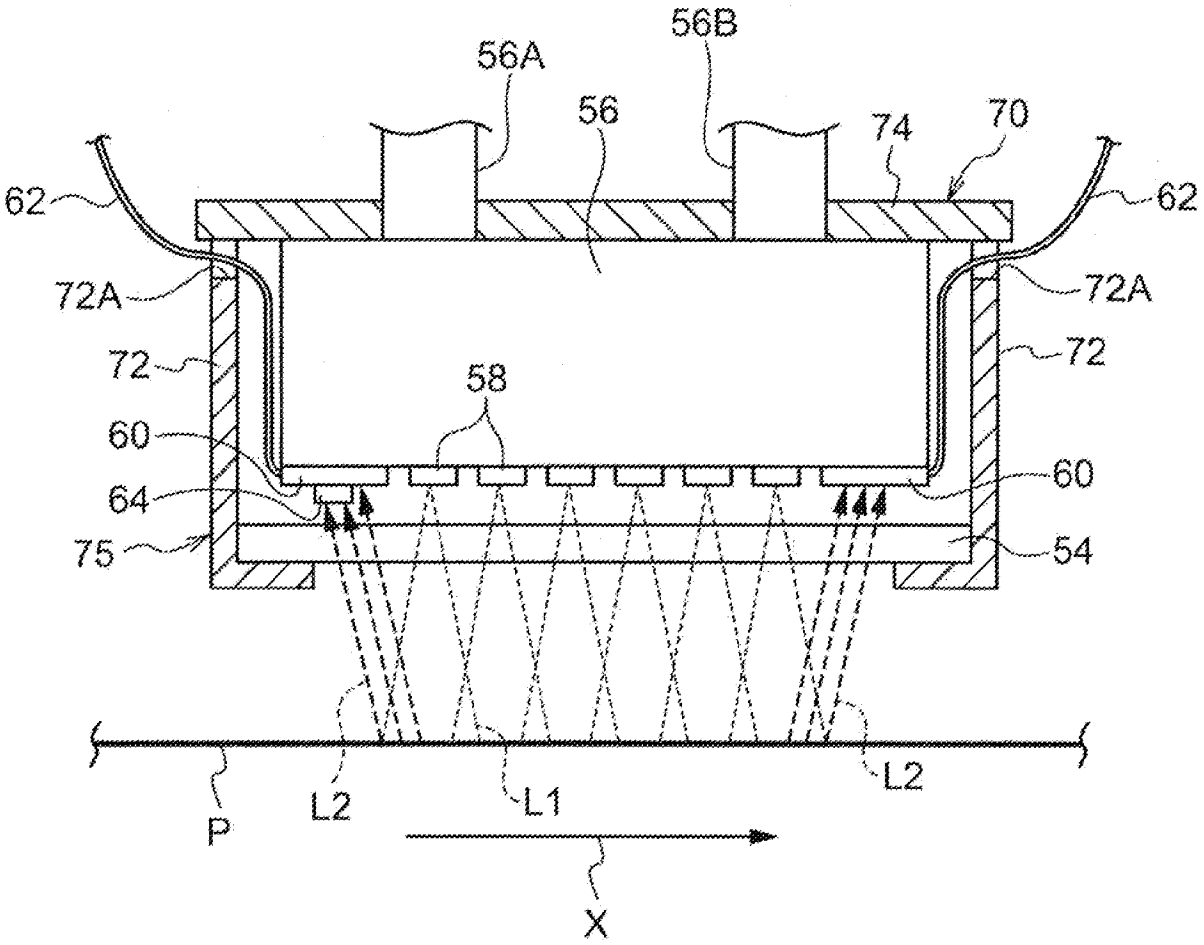
FIG. 5 is a front sectional view illustrating a configuration of a drying device according to a comparative example.

Here, the components 60, 62, and 64 are arranged in the advancing direction of the light L2 reflected by the continuous-form paper P at the drying device 50. Therefore, the components 60, 62, and 64 are irradiated with the reflected light L2 from the continuous-form paper P in the configuration (comparative example) in which a light path through which the reflected light L2 advances is secured between the continuous-form paper P and the components 60, 62, and 64 as illustrated in FIG. 5. This may heat the components 60, 62, and 64 and damage the components 60, 62, and 64 over time. In a case of using white paper as the continuous-form paper P, reflectance at a portion where no image has been formed is about 80%, for example.

In contrast, the light blocking units 76 block the reflected light L2 advancing from the continuous-form paper P toward the components 60, 62, and 64 as illustrated in FIG. 2 in the exemplary embodiment. Therefore, the components 60, 62, and 64 is not easily irradiated with the reflected light L2, and the damage on the components 60, 62, and 64 is suppressed. The damage on the components 60, 62, and 64 is suppressed as described above, thereby suppressing operation failures of the drying device 50 and thus suppressing the drying failures of the continuous-form paper P.

Also, the light blocking units 76 also function as the support units that support the glass plate 54 from the side of the continuous-form paper P in the exemplary embodiment. Therefore, the number of members is reduced as compared with a configuration in which the support units and the light blocking units 76 are provided as separate members.

(Drying Device 150 According to First Modification Example)

Figure 6:
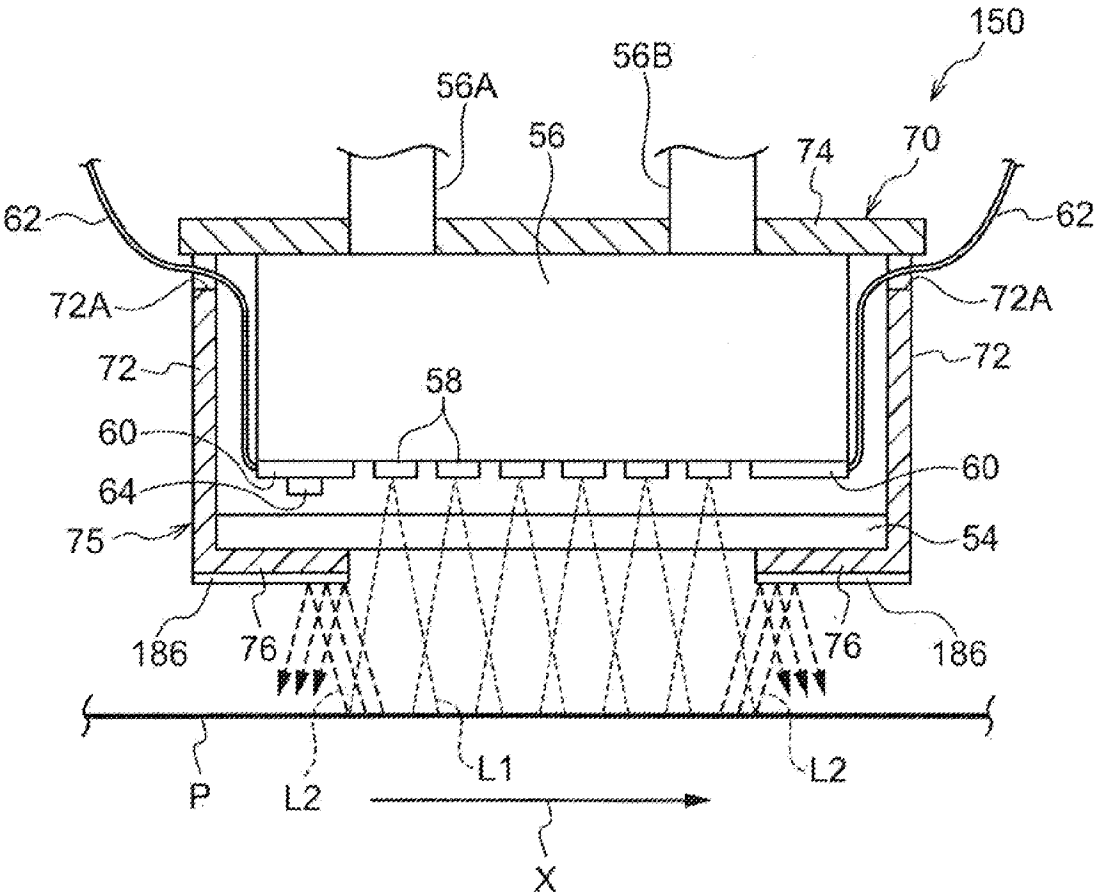
FIG. 6 is a front sectional view illustrating a configuration of a drying device according to a first modification example.

In a drying device 150, reflecting films 186 (an example of the reflecting unit) that reflect the reflected light L2 toward the lower side (the side of the continuous-form paper P) are provided on the lower surfaces (the portions on the side of the continuous-form paper P) of the light blocking units 76 as illustrated in FIG. 6. The drying device 150 is different from the drying device 50 in this point.

The reflecting films 186 are formed by plating or coating or formed of a deposited film. The reflecting units may be provided by mirror-like finishing (polishing, for example) the surfaces of the light blocking units 76.

According to the drying device 150, the reflecting films 186 does not only block the reflected light L2 advancing from the continuous-form paper P toward the components 60, 62, and 64 but also reflects the reflected light L2 toward the side of the continuous-form paper P. Therefore, irradiation efficiency of irradiating the continuous-form paper P with the laser beam is enhanced as compared with a configuration in which the reflected light L2 is not reflected toward the continuous-form paper P. Therefore, drying efficiency of the continuous-form paper P is enhanced. Also, an increase in the temperature of the case body 70 including the light blocking units 76 due to absorption of the reflected light L2 is suppressed by reflecting the reflected light L2.

(Drying Device 250 According to Second Modification Example)

Figure 7:
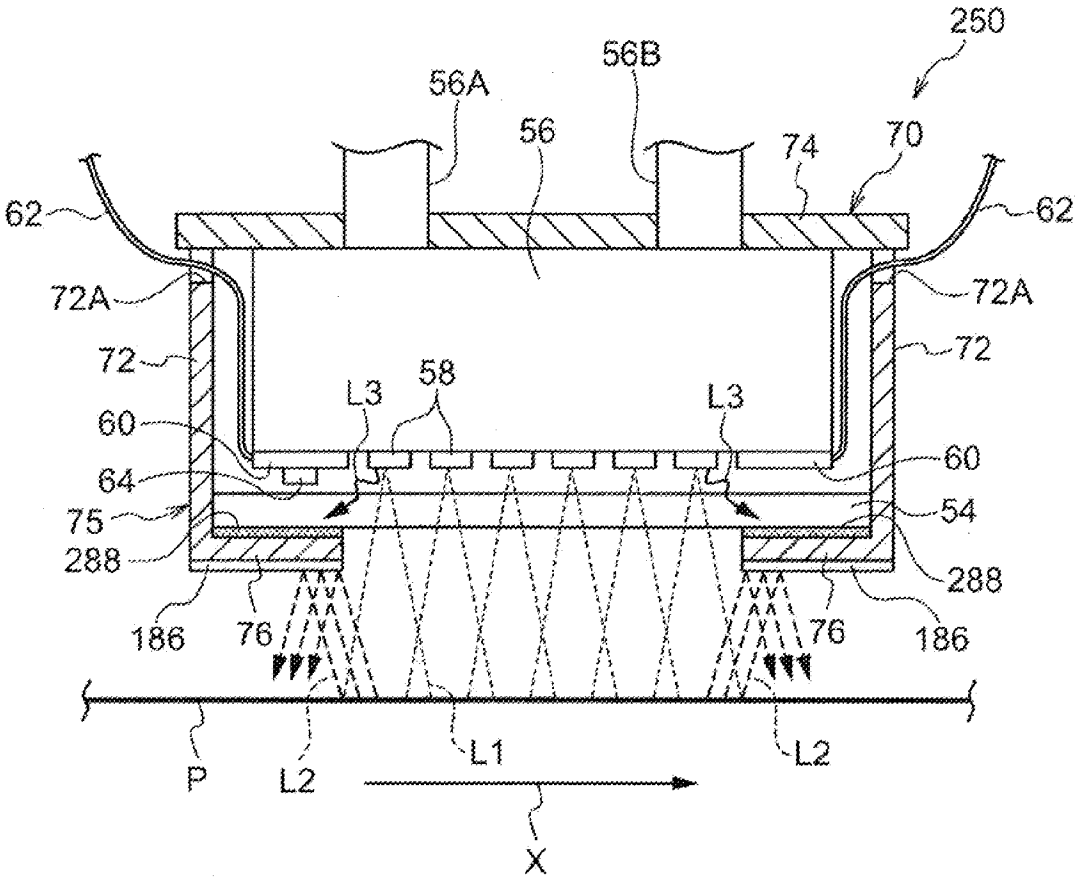
FIG. 7 is front sectional view illustrating a configuration of a drying device according to a second modification example.

In a drying device 250, absorption films 288 (an example of the absorbing unit) that absorb the laser beam from the chips 58 are provided on the upper surfaces (the portions on the side of the components 60, 62, and 64) of the light blocking units 76 as illustrated in FIG 7. The drying device 250 is different from the drying device 150 in this point.

The absorption films 288 may be provided by electroless nickel plating, black alumite treatment, Raydent treatment (registered trademark), or black film coating, for example.

According to the drying device 250, stray light or laser beam L3 in a wide angle range are absorbed by the absorption films 288 even in a case where the stray light and the laser beam L3 in the wide angle range in the laser beam L1 emitted from the chips 58 are emitted toward the light blocking units 76. Therefore, the damage on the components 60, 62, and 64 is suppressed as compared with a configuration which the stray light and the laser beam L3 in the wide angle range are reflected toward the components 60, 62, and 64 by the light blocking units 76.

Although the drying device 250 includes the reflecting films 186 and the absorption films 288, another configuration is also applicable in which the absorption films 288 are provided without the reflecting films 186.

(Drying Device 350 According to Third Modification Example)

Figure 8:
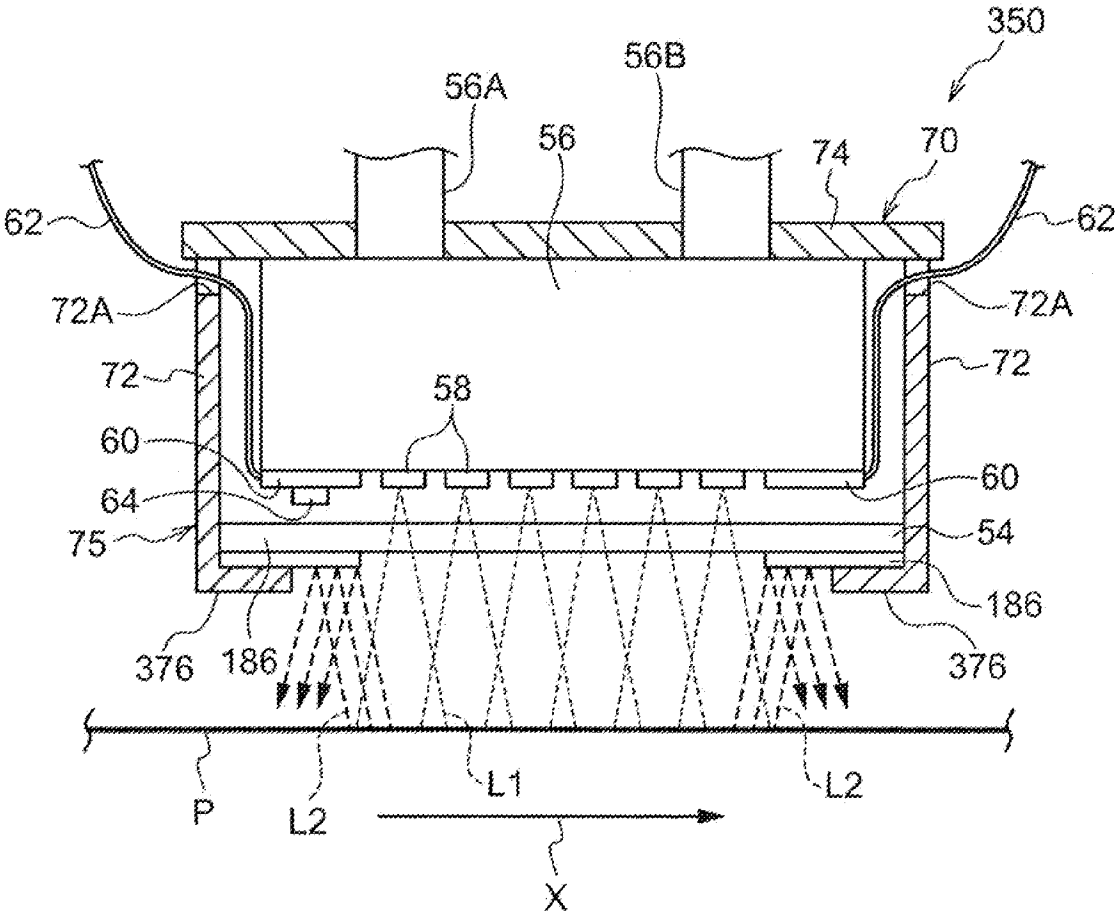
FIG. 8 is a front sectional view illustrating a configuration of a drying device according to a third modification example.

In a drying device 350, reflecting films 186 (an example of the light blocking unit) that reflect the light L2 toward the lower side (the side of the continuous-form paper P) are provided on the lower surface of the glass plate 54 as illustrated in FIG. 8. The reflecting films 186 are arranged between the continuous-form paper P and the components 60, 62, and 64 in the advancing direction of the reflected light L2 and block the reflected light L2 advancing toward the components 60, 62, and 64. That is, the reflecting films 186 function as an example of the light blocking unit with a reflecting unit. The two reflecting films 186 have a gap therebetween and secure a light path of the laser beam L1 emitted from the chips 58 toward the continuous-form paper P.

The drying device 350 includes support units 376 that support the glass plate 54 from the side of the continuous-form paper P instead of the light blocking units 76 in the drying device 50. The support units 376 are not arranged in the advancing direction (light blocking range) of the reflected light L2 and does not have a function of blocking the reflected light L2.

The reflected films 186 are arranged up to the side ends of the glass plate 54 and are pinched between the side ends of the glass plate 54 and the support units 376. The drying device 350 is different from the drying device 150 in the aforementioned points.

According to the drying device 350, the reflecting films 186 does not only block the reflected light L2 advancing from the continuous-form paper P toward the components 60, 62, and 64 but also reflects the reflected light L2 toward the side of the continuous-form paper P. Therefore, irradiation efficiency of irradiating the continuous-form paper P with the laser beam is enhanced as compared with the configuration in which the reflected light L2 is not reflected toward the continuous-form paper P. Therefore, the drying efficiency of the continuous-form paper P is enhanced. In addition, the increase in the temperature of the case body 70 due to the absorption of the reflected light L2 is suppressed by reflecting the light L2.

(Drying Device 450 According to Fourth Modification Example)

Figure 9:
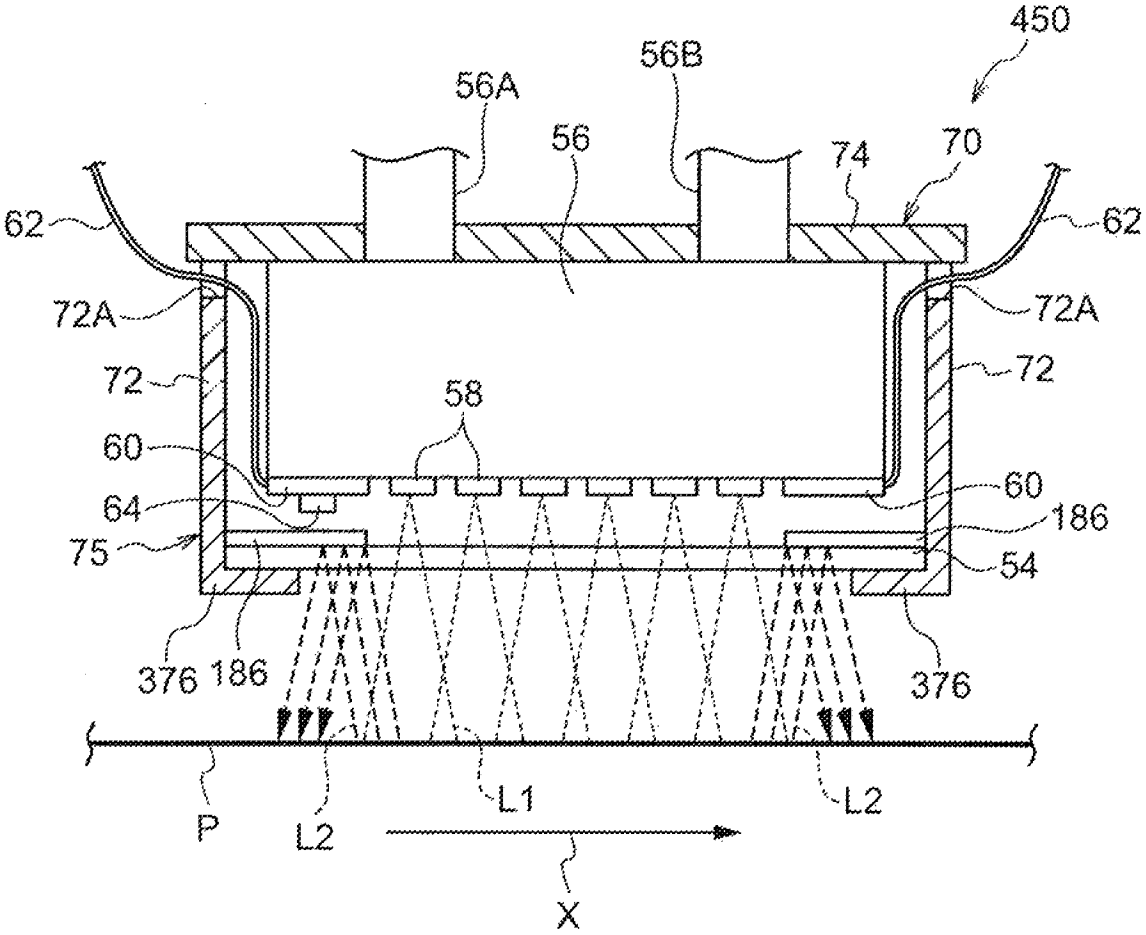
FIG. 9 is a front sectional view illustrating a configuration of a drying device according to a fourth modification example.

In a drying device 450, the reflecting films 186 (an example of the light blocking unit) that reflects the reflected light L2 toward the lower side (the side of the continuous-form paper P) are provided on the upper surface of the glass plate 54 as illustrated in FIG 9. The reflecting films 186 are arranged between the continuous-form paper P and the components 60, 62, and 64 in the advancing direction of the reflected light L2 and block the reflected light L2 advancing toward the components 60, 62, and 64. That is, the reflecting films 186 function as an example of the light blocking unit with the reflecting unit. The two reflecting films 186 have a gap therebetween and secure a light path of the laser beam L1 emitted from the chips 58 toward the continuous-form paper P. The drying device 450 is different from the drying device 350 in the aforementioned points.

As described above, the light blocking units and the reflecting units can be arranged at various positions between the continuous-form paper P and the components 60, 62, and 64 in the advancing direction of the reflected light L2.

(Drying Device 550 According to Fifth Modification Example)

Figure 10:
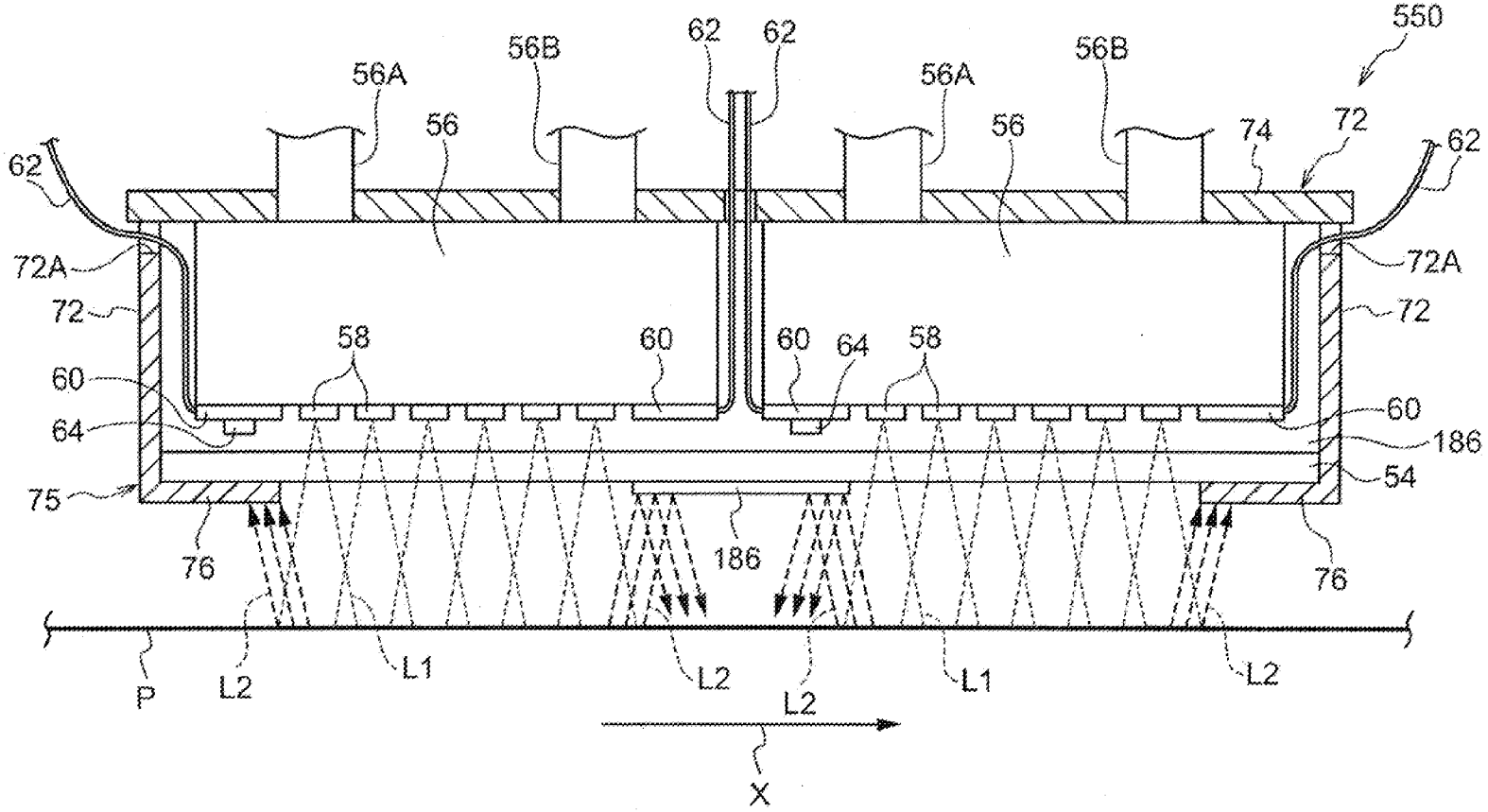
FIG. 10 is a front sectional view illustrating a configuration of a drying device according to a fifth modification example.

In a drying device 550, the plural coolers 56 arranged in the intersecting direction Y are arranged in a plural (two in the example of FIG. 10) arrays in the feeding direction X as illustrated in FIG. 10. That is, the coolers 56 are arranged in the two-dimensional manner. The coolers 56 arranged in the two-dimensional manner are accommodated in the case body 70. In such a configuration, the plural coolers 56 arranged in the two-dimensional manner are protected by a single (common) glass plate 54.

In such a configuration, the light blocking units 76 are arranged on the downstream side and the upstream side of the glass plate 54 in the feeding direction X. In contrast, the light blocking units 76 are not arranged at the center of the glass plate 54 in the feeding direction X, and the reflecting films 186 are provided. In this way, the reflected light L2 may be blocked by providing the reflecting films 186 at the center in the feeding direction X where the support units that support the glass plate 54 are not easily arranged.

(Other Modification Examples)

Although the drying device as an example of an irradiation device was described in the exemplary embodiment, the irradiation device is not limited to the drying device. As the irradiation device, an irradiation device that irradiates a target with light for illumination and any device that irradiates a target with light may be employed, for example.

Although the continuous-form paper P was used as the target of irradiation in the exemplary embodiment, the target of the irradiation is not limited thereto, and any target may be used as long as the target is a reflecting object that reflects light.

Although the example in which the printed wiring boards 60, a part of the flexible printed circuits 62, and the thermistors 64 were applied as examples of components arranged in the advancing direction of the reflected light L2 was described in the exemplary embodiment, the components are not limited thereto. The components may be at least one of other electronic component or at least one of other component with low heat resistance, for example.

The invention is not limited to the aforementioned exemplary embodiment, and various modifications, amendments, and improvements can be made without departing from the gist thereof. For example, the aforementioned modification examples may be appropriately configured as a combination of a plural modification examples.

What is claimed is:

1. An irradiation device comprising:

an irradiation unit that irradiates a target with light;

at least one component that is arranged in an advancing direction of light reflected by the target;

a light blocking unit that is arranged between the target and the at least one component in the advancing direction and blocks the reflected light;

a transmitting member that is arranged between a side in which the irradiation unit and the at least one component are provided and the target, the light being transmitted through the transmitting member;

the light blocking unit supporting the transmitting member from a side in which the target is provided; and the transmitting member is disposed beneath the irradiation unit and the at least one component in a horizontal plane.

2. The irradiation device according to claim 1, further comprising:

a reflecting unit that is provided at a part, in the side in which the target is provided, of the light blocking unit and reflects the reflected light toward the side in which the target is provided.

3. The irradiation device according to claim 1, further comprising: an absorbing unit that is provided at a part, in a side in which the at least one component is provided, of the light blocking unit and absorbs the light from the irradiation unit.

4. The irradiation device according to claim 2, further comprising: an absorbing unit that is provided at a part, in a side in which the at least one component is provided, of the light blocking unit and absorbs the light from the irradiation unit.

5. An image forming apparatus comprising:

an image forming unit that ejects liquid droplets onto a recording medium, thereby forming an image; and irradiation device according to claim 1 that irradiates the recording medium as the target with light, thereby drying the recording medium.

* * * * *